US006161268A

United States Patent [19]

Joseph

[11] Patent Number: 6,161,268

[45] Date of Patent: Dec. 19, 2000

[54] MODULAR NICHE CONSTRUCTION

[76] Inventor: Charles Joseph, 13696 Fredericktown Rd., East Liverpool, Ohio 43920

[21] Appl. No.: 09/327,268

[22] Filed: Jun. 7, 1999

[51] Int. Cl.[7] ..... A61G 17/00

[52] U.S. Cl. ..... 27/35; 27/1; 52/134; 52/136

[58] Field of Search ..... 27/35, 1; 52/128, 52/134, 136, 137

[56] References Cited

U.S. PATENT DOCUMENTS

| | | | |
|---|---|---|---|
| 2,513,951 | 7/1950 | McClellan . | |
| 3,183,574 | 5/1965 | Diem . | |
| 3,417,521 | 12/1968 | Welsh . | |
| 3,529,730 | 9/1970 | Thompson . | |
| 3,754,805 | 8/1973 | Pangburn et al. . | |
| 3,898,718 | 8/1975 | Eubank | 27/35 |
| 3,925,944 | 12/1975 | Pickel . | |
| 3,940,894 | 3/1976 | Nunes . | |
| 4,521,999 | 6/1985 | Flanagan . | |
| 4,607,417 | 8/1986 | Hancovsky . | |
| 5,134,758 | 8/1992 | Christensen . | |
| 5,287,603 | 2/1994 | Schorman . | |
| 5,740,637 | 4/1998 | Snow | 27/35 X |

*Primary Examiner*—Terry Lee Melius
*Assistant Examiner*—William L. Miller
*Attorney, Agent, or Firm*—Harpman & Harpman

[57] ABSTRACT

A modular storage system for the internment of cremated human remains including interengaging construction blocks having a plurality of pre-formed recesses therein. Storage tubes each having a closure registerable within the recesses forms a self-supporting wall of multiple blocks with multiple niches. Each of the construction blocks has lifting engagement fixtures for positioning and alignment of the blocks defining structural interior walls.

8 Claims, 5 Drawing Sheets

MODULAR NICHE CONSTRUCTION

BACKGROUND OF THE INVENTION

1. Technical Field

This invention relates to construction of storage structures for the internment of cremated human remains and more particularly to niche construction formed of pre-cast concrete.

2. Description of Prior Art

Prior art niche construction has utilized a variety of different construction techniques depending generally on the structural requirement to form a storage structure with a plurality of individual depository niches within. Typically, the niches are formed by setting up a form having a number of recesses within and reinforcing elements, pouring concrete within the form defining a basic structural wall with a plurality of openings therein. Pre-cast walls have multiple niche recesses therein have also been developed wherein a wall is cast with a plurality of niche openings formed therein. Other construction methods use a number of interconnected tubes that are secured within a wall structure. Such examples of the prior art can be seen in U.S. Pat. Nos. 3,529,730, 3,417,521 and 5,134,758.

In U.S. Pat. No. 3,417,521 an animal mausoleum construction is disclosed having footers, walls and a poured top beam of concrete. Rows of square blocks bisected into square openings define an open frame in which the remains are placed.

U.S. Pat. No. 3,529,730 is directed to a repository for concrete remains formed by placing a plurality of tubes in a storage array, each tube having an end cap for sealing purposes.

Finally, in U.S. Pat. No. 5,134,758 a niche construction is illustrated in which a wall is formed by pouring concrete around a plurality of forms defined by individual plastic boxes which then become the liners for the recesses thus formed.

SUMMARY OF THE INVENTION

A plurality of pre-formed independent construction blocks having multiple independent recesses within are stacked together to form a self-supporting niche internment wall within an existing structure. Registering sealed internment tubes are placed within the respective recesses and covered by a decorative panel overlying the entire block access surface.

DESCRIPTION OF THE PREFERRED EMBODIMENT

Figure 1:
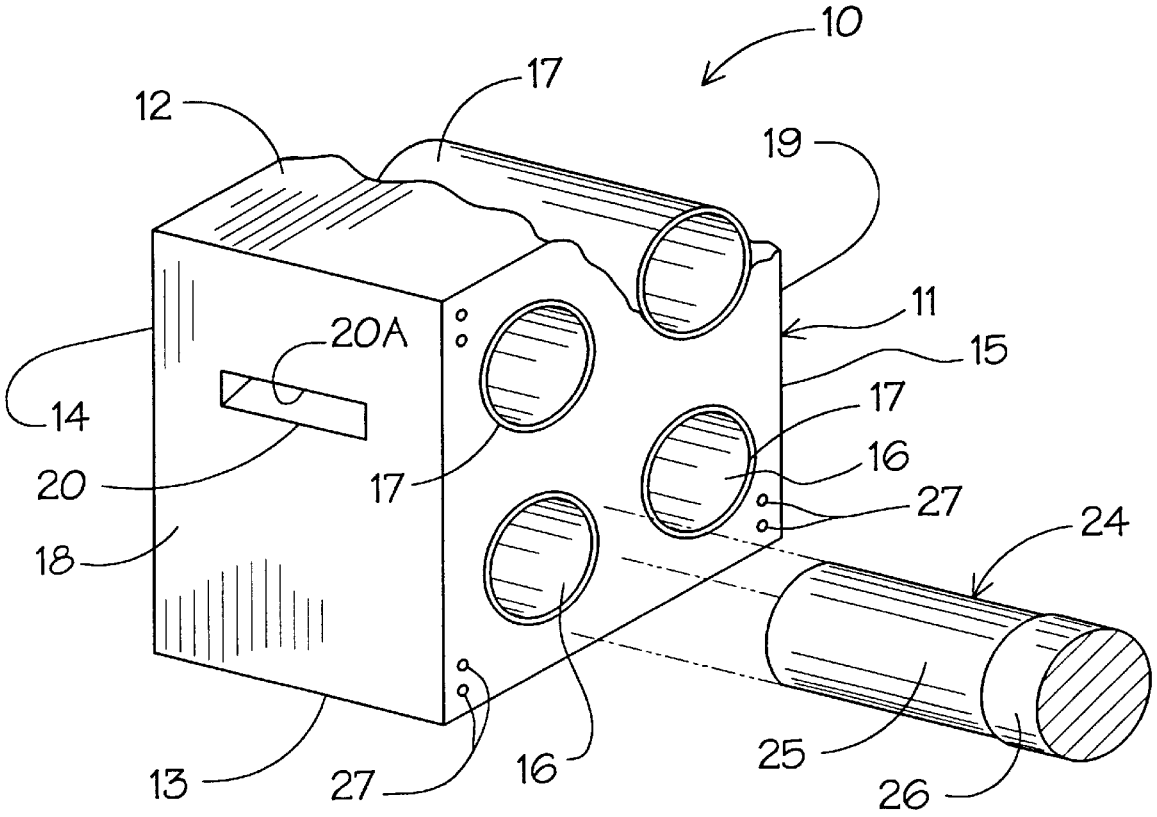
FIG. 1 is a perspective view of the storage construction blocks of the invention with portions broken away and representative insert storage tubes aligned for positioning therein.
Figure 2:
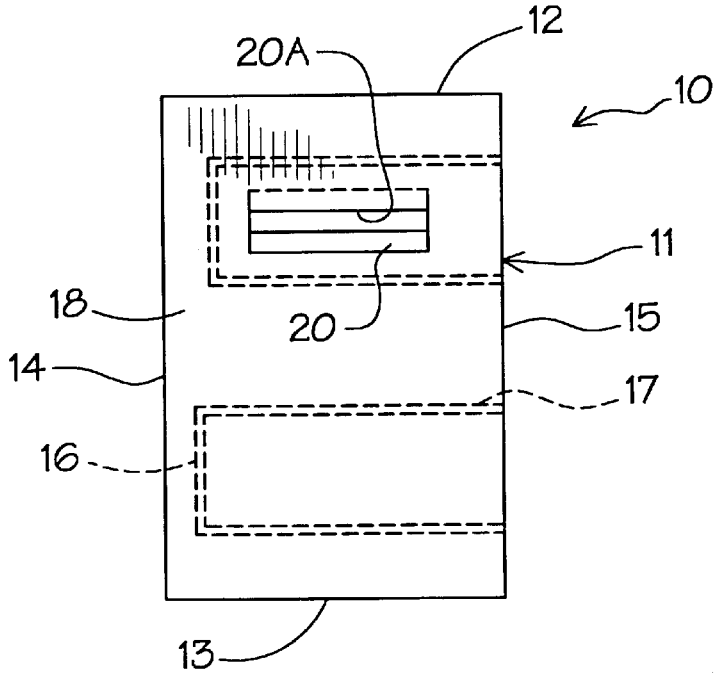
FIG. 2 is a side elevational view of the storage construction block of the invention.
Figure 3:
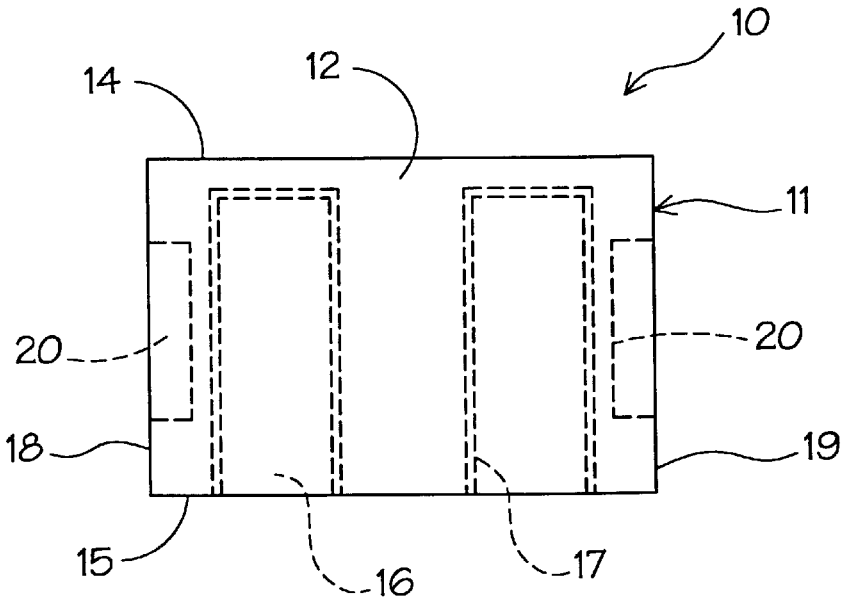
FIG. 3 is a top plan view of the storage construction block of the invention.

Referring to FIGS. 1–3 of the drawings, a niche construction block 10 can be seen having a main body member 11 with a featureless top, bottom and rear surfaces 12, 13 and 14 respectively. A front surface 15 has a plurality of evenly spaced annular recesses 16 therein formed by multiple internment receiving sleeves 17, cast within of synthetic resin material as best seen in FIG. 1 of the drawings. A pair of oppositely disposed side surfaces 18 and 19 on the block interconnect said respective front, rear, top and bottom surfaces defining the monolithic construction block 10 of the invention. Engagement hand holds 20 are formed in the respective side surfaces inwardly from front, rear and top surfaces. Each of the hand holds 20 are formed by an elongated slot having inclined interior engagement surface 20A as best seen in FIGS. 1 and 2 of the drawings.

Figure 4:
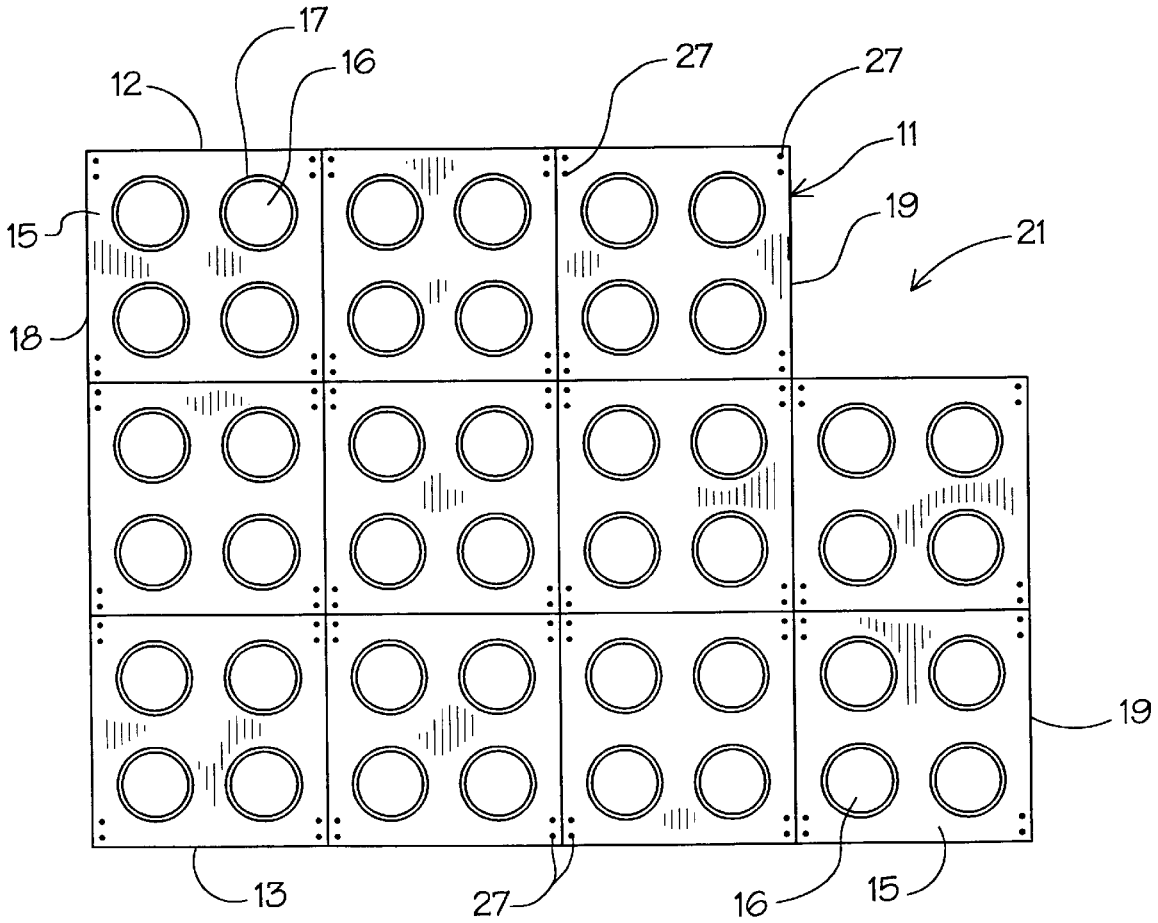
FIG. 4 is a side elevational assembly view showing multiple storage construction blocks positioned together forming a wall structure.
Figure 5:
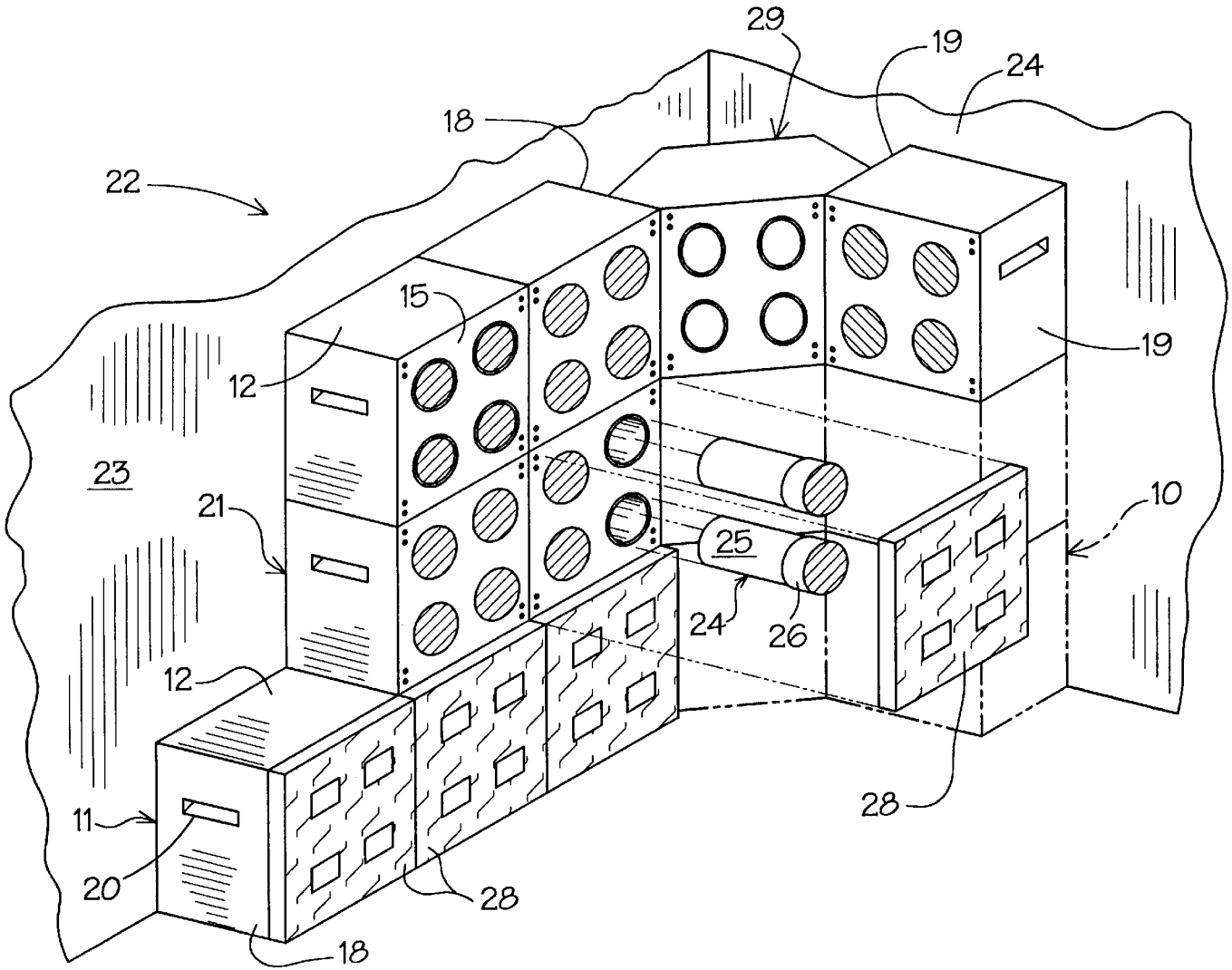
FIG. 5 is a perspective assembly view of the storage construction blocks in a typical installation with respective insert storage tubes and decorative flush panels positioned thereon.

It will be evident from the above description that when the niche storage construction blocks 10 are stacked together in side by side relationship that a self-supporting internment wall 21 is formed as illustrated in FIGS. 4 and 5 of the drawings.

In a typical application, the arrangement of the construction blocks 10 can be such that they are used in existing structures 22 converting unused walls 23 and 24 into custom internment niches without the requirement and cost of stand alone mausoleums or related structures.

Remains repository cylinders 24 as illustrated in FIGS. 1 and 5 of the drawings are formed of a sealed tube 25 having a removable access closure 26 that is registerable within the respective hereinbefore described internment receiving sleeve 17 flush with the front surface 15 of the construction block 10. The remains repository cylinders 24 are preferably made of synthetic resin material or of traditional metal compounds used within the industry.

A plurality of registration fittings 27 are embedded within the front wall surface 15 providing multiple attachment points for fasteners (not shown) on cover plates 28 which overlie the entire front surface 15 as best seen in FIG. 5 of the drawings.

Figure 6:
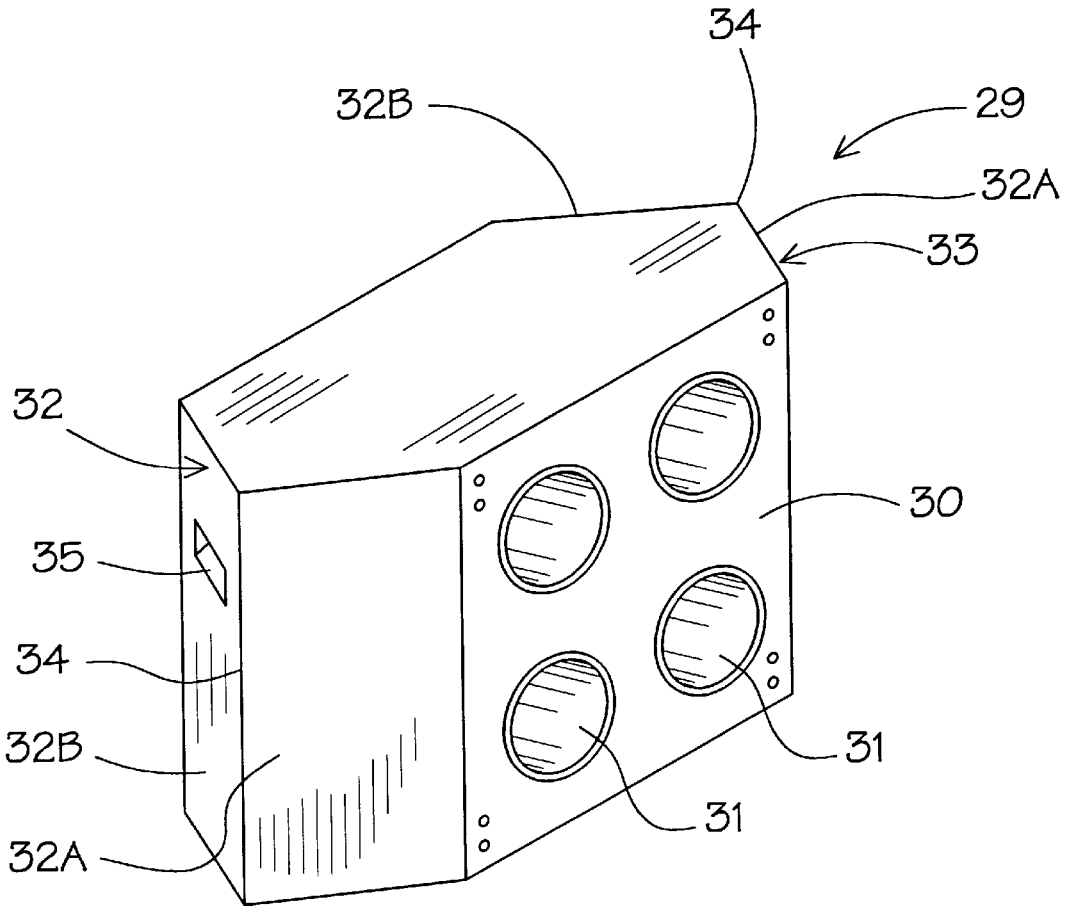
FIG. 6 is a perspective view of a corner storage construction block having angled extensions to provide a ninety-five degree corner connecting block.

As hereinbefore discussed, the niche construction blocks 10 are arranged to form a niche wall 21. When the niche wall 21 is assembled on intersecting building walls 23 and 24, a special corner niche block 29 illustrated in FIGS. 5 and 6 of the drawings is used. The corner niche block 29 has a front surface 30 with a plurality of spaced annular recesses 31 therein formed by internment receiving sleeves 31A cast within. Angled sidewalls 32 and 33 each have a pair of angular side surfaces 32A and 32B that intersect at 34 extending at 45 degrees in relation to the front and rear surfaces.

It will seen that in use the corner niche construction block 29 is arranged to abut the adjacent side surfaces 18 and 19 of the respective niche construction blocks 10 defining a transitional corner providing additional internment niches therein.

Each of the corner niche blocks 29 have hand engagement recesses 35 in their respective angled side surfaces 32B which are of the same structural configuration as that of the hereinbefore described hand holds 20.

The niche construction block 10 and corner niche construction blocks 29 are preferable formed of cast concrete material or durability and structural integrity using typical casting techniques well known within the industry.

It will thus be seen that a new and useful modular storage system for the internment of cremated human remains has been illustrated and described and will be apparent to those skilled in the art that various changes and modifications may be made therein without departing from the spirit of the invention.

Therefore I claim:

1. A modular wall niche construction for the internment of cremated remains comprising in combination a plurality of niche construction blocks each having a solid, top, bottom, back and side surfaces, said niche construction blocks being arranged together inside by side and top to bottom relationship to one another to form said modular wall niche construction, a front surface of said niche construction block has a plurality of spaced recesses therein, a plurality of individual repository cylinders registerably secured within said respective spaced recesses in said block, said niche construction block being cast of concrete material, said spaced recesses in said niche construction block formed by a plurality of cylindrical receiving forms embedded partially within and defining cylinder receiving compartments within said construction block, engagement means for positioning said niche construction block in a niche wall alignment, and means for selectively securing a decorative panel over multiple said space recesses in niche construction block, said decorative panel is of a dimension equal to that of said front surface of said niche construction block.

2. The modular niche wall construction set forth in claim 1 wherein said niche construction blocks are of equal dimensions to one another.

3. The modular niche wall construction set forth in claim 1 wherein said repository cylinders have a sealed and a removable access closure on their free ends.

4. The modular niche wall construction set forth in claim 1 wherein said engagement means for positioning said niche construction block in a niche wall alignment comprises, a pair of oppositely disposed hand engagement slots in said respective sidewalls of said niche construction block.

5. The engagement means set forth in claim 4 wherein said hand engagement slots have parallel angled top and bottom interior surfaces.

6. The modular niche wall construction set forth in claim 1 wherein said means for selectively securing the decorative panel over said spaced recesses in said niche construction block comprises; a plurality of registration fittings embedded within said front surface about said recesses therein.

7. The modular niche wall construction set forth in claim 6 wherein said decorative panel has a plurality of fasteners positioned therein for registration within said registration fittings embedded within said front surface about said recesses.

8. The modular niche wall construction set forth in claim 1 wherein some of said niche construction blocks are of a corner configuration having a pair of oppositely disposed angled sidewalls, said angled sidewalls comprising, a pair of angular surfaces extending from said blocks front and rear surfaces intersecting one another and a hand engagement opening in one of said angled side surface pairs.

* * * * *